US006324991B1

(12) United States Patent
Friedrich et al.

(10) Patent No.: US 6,324,991 B1
(45) **Date of Patent: *Dec. 4, 2001**

(54) CROSS-OVER FOR TRACK-GRIPPING, TRACK-BOUND VEHICLES

(75) Inventors: Hans-Peter Friedrich, Zorneding; Fritz Kummer, Munich, both of (DE)

(73) Assignee: MVP-Versuchs-und Planungsgesellschaft fur Magnetbahnsysteme mbH, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,749

(22) PCT Filed: May 20, 1997

(86) PCT No.: PCT/EP97/02567

§ 371 Date: Feb. 1, 1999

§ 102(e) Date: Feb. 1, 1999

(87) PCT Pub. No.: WO98/05820

PCT Pub. Date: Feb. 12, 1998

(30) Foreign Application Priority Data

Aug. 2, 1996 (DE) ..... 196 31 324

(51) Int. Cl.[7] ..... E01B 25/00

(52) U.S. Cl. ..... 104/130.01; 104/130.11

(58) Field of Search ..... 104/96, 99, 100, 104/101, 102, 103, 104, 130.01, 130.02, 130.03, 130.04, 130.05, 130.06, 130.11

(56) References Cited

U.S. PATENT DOCUMENTS

| | | | | |
|---|---|---|---|---|
| 3,635,166 | | 1/1972 | Peterson | 104/130 |
| 4,109,584 | * | 8/1978 | Mihirogi | 104/130.06 |
| 4,890,804 | * | 1/1990 | Teramoto et al. | 104/130.01 |
| 4,938,149 | * | 7/1990 | Lotzer | 104/102 |
| 5,119,732 | * | 6/1992 | Lisy | 104/102 |
| 5,193,767 | * | 3/1993 | Mihirogi | 104/130.01 |

FOREIGN PATENT DOCUMENTS

| | | |
|---|---|---|
| 1025440 | 3/1958 | (DE) . |
| 1093395 | 11/1960 | (DE) . |
| 1223863 | 9/1966 | (DE) . |
| 2462161 | 5/1976 | (DE) . |
| 4416819A1 | 11/1995 | (DE) . |

OTHER PUBLICATIONS

PCT International Search Report, Aug. 1997, PCT/EP97/02567.

* cited by examiner

*Primary Examiner*—Mark T. Le
(74) *Attorney, Agent, or Firm*—Perman & Green, LLP

(57) ABSTRACT

A cross-over between tracks (1, 2) for track-gripping, track-bound vehicles consists of two parallel adjacent movable track elements (3) coupled to each other by several connection elements (4) of constant length. The track elements (3) can take two or three defined positions and allow changing from ne track to another without altering the track gauge. The connecting elements can be actuated by a common driving unit.

14 Claims, 4 Drawing Sheets

CROSS-OVER FOR TRACK-GRIPPING, TRACK-BOUND VEHICLES

BACKGROUND OF THE INVENTION

The invention relates to an interchange connection between tracks for track-encompassing track-guided vehicles.

1. Prior Art

Track guide means permit safe and on-track guidance and support of vehicles, which can be joined together to form long trains. In railways and tramways, the track guide means of the vehicles (wheels) act from inside on the left and right track guide means of the track (rails) which are stationary and laid with a uniform spacing. The supporting function of the track acts from beneath on the tread of the wheels of the vehicle standing or travelling over the track guide means.

Since the track guide means of the vehicles do not positively encompass the track guide means of the track, the track guide means of the track can be given a slender construction. In the case of interchange connections (points with a crossing frog), therefore, there is also no need to increase the distance between parallel tracks.

If, on the other hand, the track guide means of the vehicles positively encompass the track guide means of the track, and the track provides support to the vehicles via the vehicle running or suspension frames, constructions of this kind are for example the Transrapid magnetic overhead railway and the M-line. In track changing means (points) in the said rail systems, therefore, the entire track guide means or parts thereof must be elastically curved, displaced or rotated.

Usually, in applications of rail systems to traffic, two tracks (tracks 1 and 2) are provided. In principle the tracks are laid parallel to one another with minimum spacing (dependent on speed). Interchange connections between the two tracks are obtained by providing two points, in which for example the track guide means are curved relative to one another and connected to one another either directly or via intermediate members. To provide the necessary clear space for the track-encompassing vehicles or the vehicle-encompassing track components, the prior art requires that the spacing between the two tracks must be increased in the zone of the interchange connection (see FIG. 5, which shows the free space in conventional interchange connections, where d denotes the centre-to-centre distance between tracks, reference number 10 denotes the vehicle boundary line, 12 denotes the clear space, 14 denotes the surface of intersection between the clear spaces of neighbouring lines, 16 denotes the surface of intersection between the vehicle boundary surfaces and 18 denotes the surface of intersection between the track elements).

In traffic systems with a long stator drive, i.e. where the active parts of the electric motor (moving-field guiding stators) are a component of the track, interchange places are preferably situated at the boundaries of drive and safety zones (the drive zone), so that even after a malfunction due to the drive or safety system, the track section in question can be bypassed. In the prior-art construction, e.g. a double interchange connection with four two-way points, track sections must be associated, for drive and safety purposes, with the defective zone which is to be bypassed. Complicated circuitry is needed before this bypass line can be used.

A prior art interchange connection is disclosed in DE 44 16 819 A1. This interchange connection prevents track components from obstructing the vehicle clear space, since those parts of the track between which there is no connection in the position of the points at any time, are elastically bent outwards away from the neighbouring track. This is done separately for all bendable parts of the track and with different kinematics, with the result that the interchange connection is complicated to operate.

2. Description of the Invention

The object of the invention therefore is to develop an interchange connection between tracks for track-encompassing track-guided vehicles which can be easily constructed and operated.

The interchange connection according to the invention can be subsequently installed in existing vehicles at low cost. There is no need to increase the spacing between pairs of tracks. The interchange connection is made such that the zone of the parallel track near the points is likewise constructed as points and moves out of the space for the movable track guide means and the clear space for the vehicle.

If the adjacent points carriers are adjusted by a common drive unit, the number of drive units per interchange connection can be reduced and so can the cost per interchange connection.

Other preferred exemplified embodiments are disclosed in this specification.

For example, according to one preferred feature of the invention, the interchange connection is constructed as a double interchange connection. This construction in the form of a double interchange connection enables a change to be made from the left to the right track or from the right to the left track.

In another preferred embodiment, the interchange connection comprises five or more movable track elements. The arrangement is of use both for making the track for the crossing and also for removing track zones which constitute an obstacle.

Preferably, one or more free positions of the interchange connection can be used for operating purposes, e.g. for connecting to a workshop, for flank protection or as a place for introducing vehicles into the stream of traffic.

DESCRIPTION OF EXEMPLIFIED EMBODIMENTS

Figure 1A:
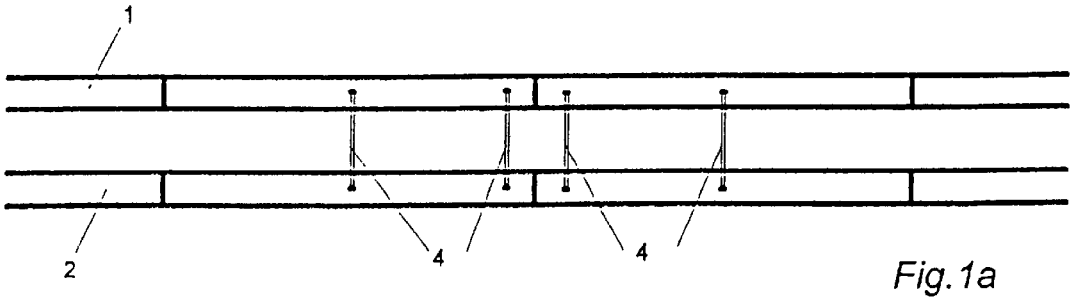
FIGS. 1*a*–1*d* are diagrams, not to scale, of an interchange connection in the position for travel straight ahead (FIG. 1*a*), in the position for branching to the right (FIG. 1*b*) and in the position for branching to the left (FIG. 1*c*); and of a connection between tracks and drive units (FIG. 1*d*)
Figure 1B:
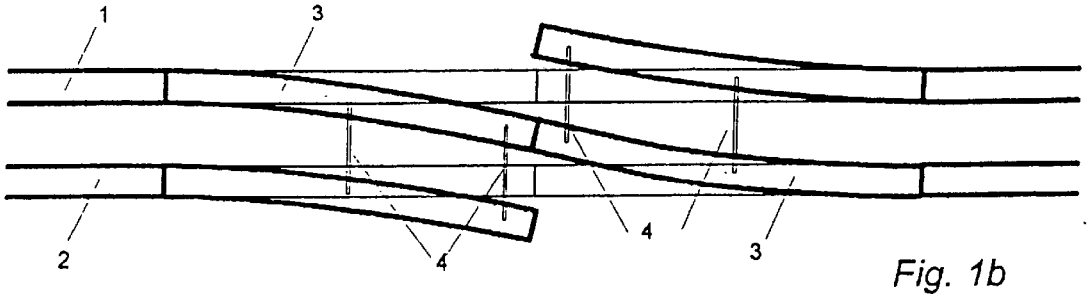
Figure 1C:
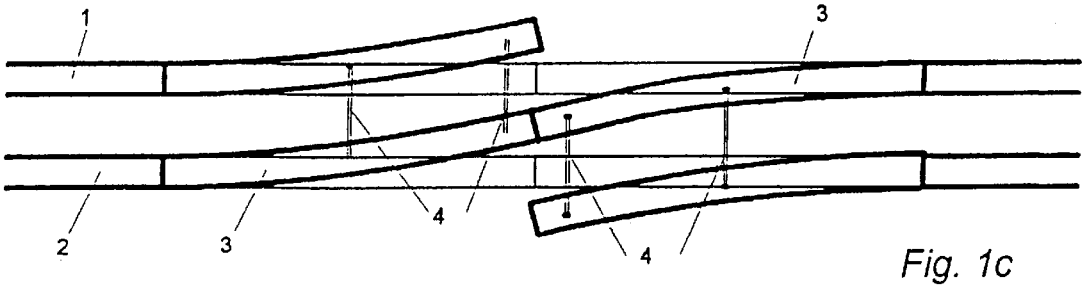

FIG. 1 by way of example shows an interchange connection comprising pairs of parallel movable track elements (e.g. conventional points) 3 which, in the position for travel straight ahead (FIG. 1*a*), enable the two parallel tracks 1 and 2 to be used without restriction. The adjacent track elements on adjacent tracks are operatively coupled by a number of connecting elements 4 of uniform length. In order to change from one track 1 to the other track 2 (the position when branching, FIGS. 1*b* and 1*c*), all four points carriers 3 are deflected by half the distance between the two tracks. The movement is obtained by elastic bending, pushing or rotating, thus forming the straight and the branching set of points in the same way as in conventional systems.

Figure 1D:
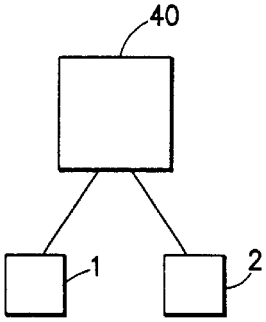

FIG. 1*d* shows a common drive unit 40 connected to two different tracks 1, 2 for joined actuation.

This prevents components of the branching track from colliding with components of the parallel track, even when the centre-to-centre distance between tracks is only slightly greater than the track width.

Figure 2A:
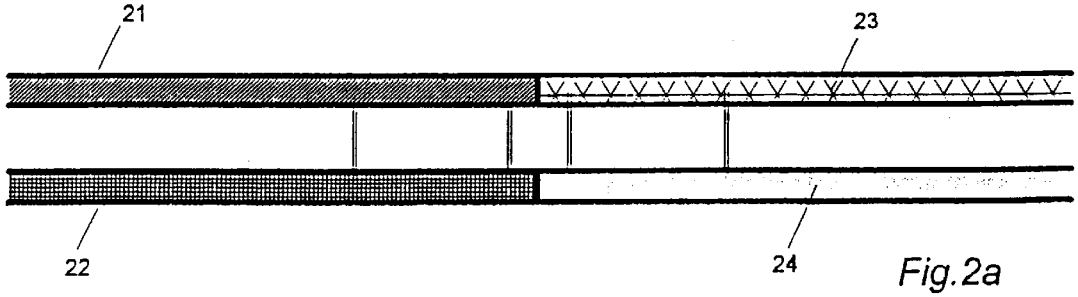
FIGS. 2*a*–2*b* show the four drive zones (21 to 24) of the long stator drive in the neighbourhood of the interchange place. In this case, as can be seen, only two drive zones (21 and 23 or 22 and 24) are needed for travel straight ahead or for branching—e.g. only two drive zones (21 and 24) in the position for branching to the right (FIG. 2*b*)
Figure 2B:
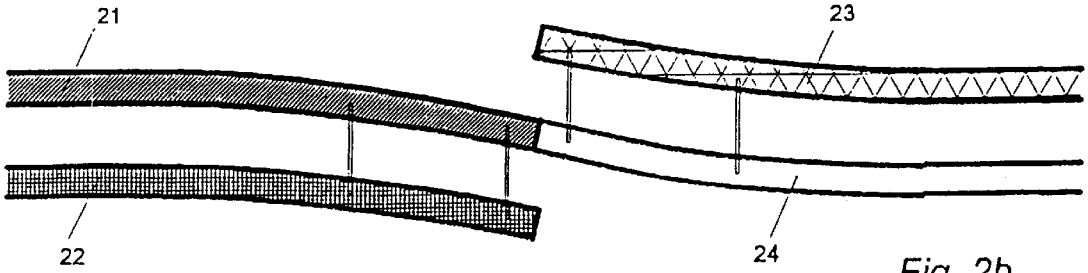

As FIG. 2 shows, operation of the drive zones 21 to 24 for the interchange connection can be simplified since, when the position of the movable track elements is altered, the boundaries between zones remain unchanged and consequently there is no need for change-over switches.

Figure 3A:
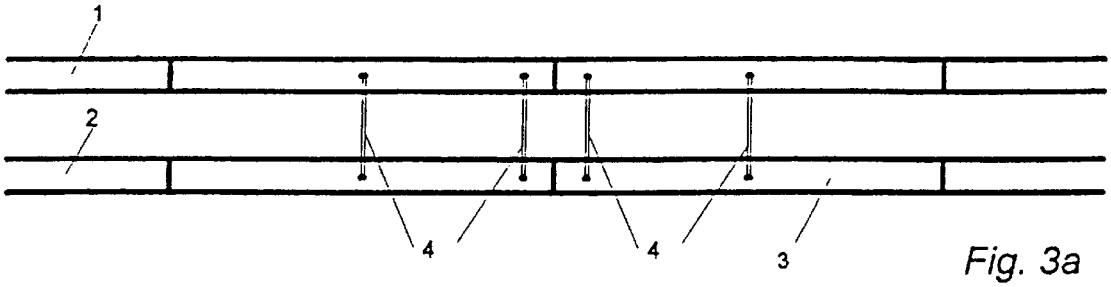
FIGS. 3*a*–3*c* are diagrams, not to scale, of a double interchange connection in the position for travel straight ahead (FIG. 3*a*), in the position for branching to the right (FIG. 3*b*) and in the position for branching to the left (FIG. 3*c*)
Figure 3B:
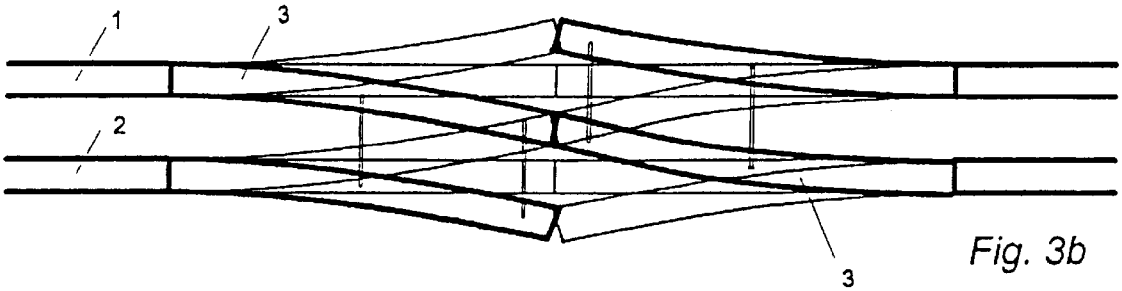
Figure 3C:
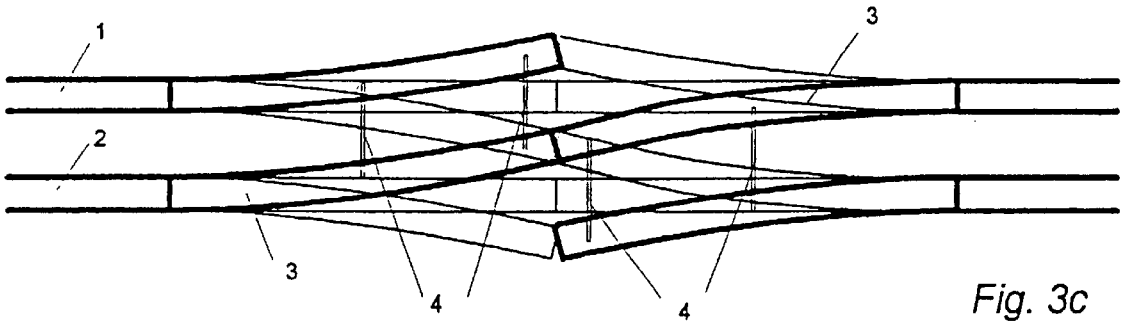

FIGS. 3*a* to 3*c* show by way of example that if the points carriers 3 are suitably constructed, they can be switched in both directions, so that alternate interchange connections can be made.

This embodiment in the form of a double interchange connection can be used for changing from the left to the right track or from the right to the left track. The points carriers 3 thus have three positions.

Figure 4A:
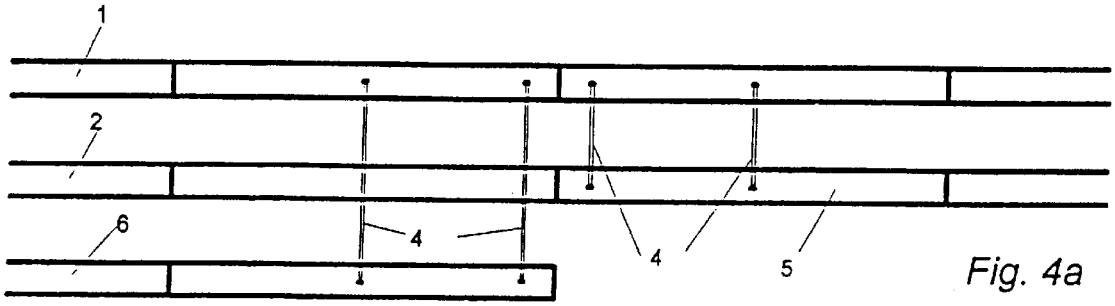
FIGS. 4*a*–4*c* are diagrams, not to scale, of a double interchange connection with five movable track elements in the position for travel straight ahead (FIG. 4*a*), in the position for branching to the right (FIG. 4*b*) and in the position for branching to the left (FIG. 4*c*)
Figure 4B:
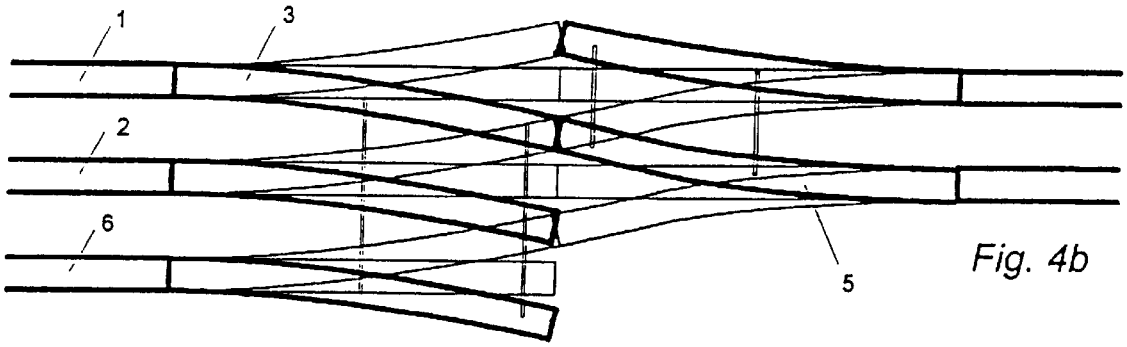
Figure 4C:
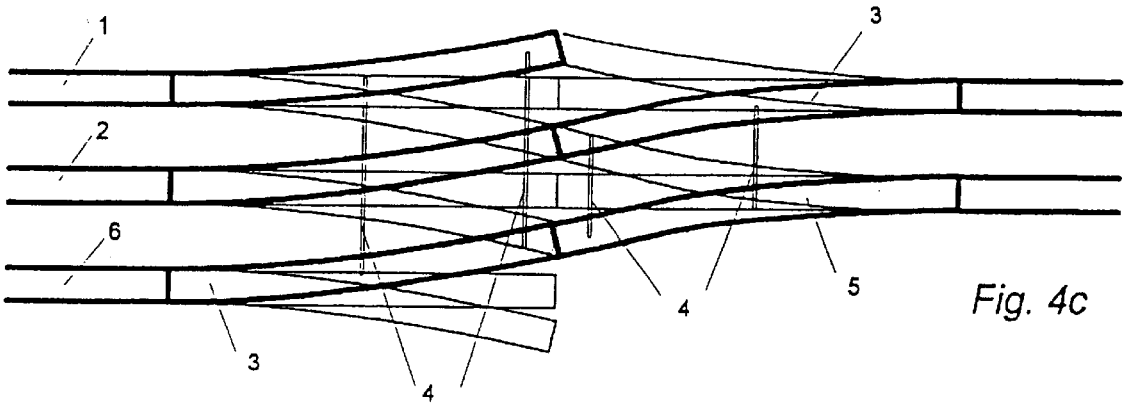
Figure 5:
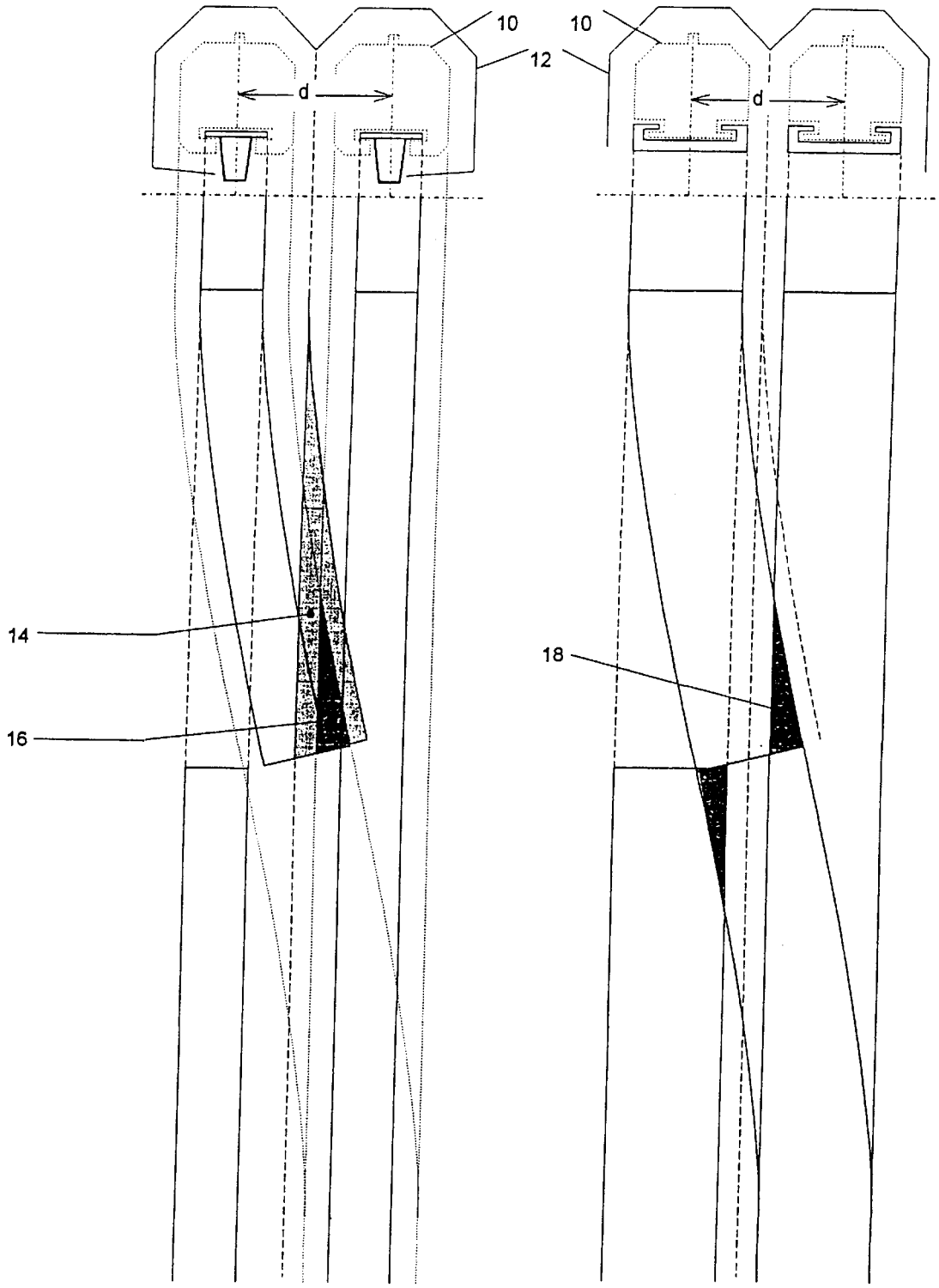
Fig. 5 (PRIOR ART)
FIG. 5 shows the clear space in conventional interchange connections.

FIGS. 4*a* to 4*c* show, by way of example, that if the number of points carriers 3 is suitable, it is also possible to connect additional tracks. When an additional track 6 is connected, e.g. in sidings and maintenance installations, individual points carriers 5 can be travelled over in three positions corresponding to FIGS. 4*a*, 4*b* and 4*c*. The points can be positioned close together, thus reducing the length required for the interchange place.

Finally, double interchange connections, which in the transrapid magnetic overhead railway are situated at the boundaries of the long stator drive zone and consequently in the neighbourhood of the substations, can be used to make an additional connection, e.g. for sidings for special vehicles, and also for removing defective vehicles from the free track.

What is claimed is:

1. A track interchange system for vehicle travel from one track to another track, said system comprising:

a plurality of tracks adapted for close-proximity travel by track encompassing, track-guided vehicles, said tracks being substantially parallel in at least an interchange region, and a distance between said tracks in said interchange region being essentially no greater than a distance between said tracks just outside of said interchange region;

each said track comprising at least a first elastically deformable section and a second elastically deformable section, each of said elastically deformable sections having a pivot end and a junction end in said interchange region, said junction end of each said elastically deformable section being positioned for selectively joining to any other one of said elastically deformable sections;

a first mechanical coupling, on one side of said interchange region, joining said first elastically deformable sections of at least two different ones of said tracks, and a second section mechanical coupling, on the other side of said interchange region, joining said second elastically deformable sections of at least two different ones of said tracks, so that elastically deformable sections joined by a respective one of said mechanical coupling are coupled for joined movement and deflection; and at least two of said tracks are connected to a common drive unit for joined movements.

2. The track interchange system in claim 1, wherein said system is a double interchange configured to allow vehicles to change tracks in either direction of travel.

3. The track interchange system in claim 1, wherein said tracks at said interchange region are configured to allow vehicles to selectively travel in a straight line or merge into a different one of said tracks on either side of said straight line.

4. The track interchange system in claim 1, wherein at least one of said track sections is adapted for coupling to a workshop.

5. The track interchange system in claim 1, wherein at least one of said track sections is adapted for flank protection.

6. The track interchange system in claim 1, wherein at least one of said track sections is adapted to separate a vehicle from a vehicle traffic stream.

7. The track interchange system in claim 1, wherein at least one of said track sections is adapted to introduce a vehicle to a vehicle traffic stream.

8. The track interchange system in claim 1, wherein said elastically deformable sections form drive zones, boundaries of said drive zones being situated at the junction ends of said elastically deformable sections, and each adjustment of said junction ends provides a direct connection between a respective pair of drive zones.

9. The track interchange system in claim 2, wherein said elastically deformable sections form drive zones, boundaries of said drive zones being situated at the junction ends of said elastically deformable sections, and each adjustment of said junction ends provides a direct connection between a respective pair of drive zones.

10. The track interchange system in claim 3, wherein said elastically deformable sections form drive zones, boundaries of said drive zones being situated at the junction ends of said elastically deformable sections, and each adjustment of said junction ends provides a direct connection between a respective pair of drive zones.

11. The track interchange system in claim 4, wherein said elastically deformable sections form drive zones, boundaries of said drive zones being situated at the junction ends of said elastically deformable sections, and each adjustment of said junction ends provides a direct connection between a respective pair of drive zones.

12. The track interchange system in claim 5, wherein said elastically deformable sections form drive zones, boundaries of said drive zones being situated at the junction ends of said elastically deformable sections, and each adjustment of said junction ends provides a direct connection between a respective pair of drive zones.

13. The track interchange system in claim 6, wherein said elastically deformable sections form drive zones, boundaries of said drive zones being situated at the junction ends of said elastically deformable sections, and each adjustment of said junction ends provides a direct connection between a respective pair of drive zones.

14. The track interchange system in claim 7, wherein said elastically deformable sections form drive zones, boundaries of said drive zones being situated at the junction ends of said elastically deformable sections, and each adjustment of said junction ends provides a direct connection between a respective pair of drive zones.

* * * * *

UNITED STATES PATENT AND TRADEMARK OFFICE

CERTIFICATE OF CORRECTION

PATENT NO. : 6,324,991 B1
DATED : December 4, 2001
INVENTOR(S) : Hans-Peter Friedrich et al.

It is certified that error appears in the above-identified patent and that said Letters Patent is hereby corrected as shown below:

Title page,
Item [54], the title should read as follows:

-- AN INTERCHANGE CONNECTION FOR TRACK-ENCOMPASSING TRACK-GUIDED VEHICLES --

Signed and Sealed this

Twentieth Day of August, 2002

*Attest:*

*Attesting Officer*

JAMES E. ROGAN
*Director of the United States Patent and Trademark Office*